United States Patent [19]

Haynes

[11] Patent Number: 4,921,301

[45] Date of Patent: May 1, 1990

[54] MATERNITY LOUNGER

[76] Inventor: R. Jalaine Haynes, Lot 314, Hillside Colony, Stillwater, N.Y. 12170

[21] Appl. No.: 148,290

[22] Filed: Jan. 25, 1988

[51] Int. Cl.[5] ..... A47C 13/00

[52] U.S. Cl. ..... 297/118; 297/284; 5/431; 5/110

[58] Field of Search ..... 297/118, 284, 283, 108, 297/210, 224, 229; 5/462, 431 X, 446, 110, 111, 112, 187, 465

[56] References Cited

U.S. PATENT DOCUMENTS

| | | | |
|---|---|---|---|
| 2,089,854 | 8/1937 | Pellegrini | 5/446 |
| 3,378,862 | 4/1968 | Skinner | 5/462 |
| 3,464,069 | 9/1969 | Bien | 5/110 |
| 3,678,520 | 7/1972 | Evans | 297/284 X |
| 3,988,793 | 11/1976 | Abitbol | 5/462 X |
| 4,376,547 | 3/1983 | Dominko | 297/118 X |
| 4,508,384 | 4/1985 | Castelot et al. | 297/284 |
| 4,536,028 | 8/1985 | Jones et al. | 297/224 |

*Primary Examiner*—Kenneth J. Dorner
*Assistant Examiner*—Jose V. Chen
*Attorney, Agent, or Firm*—Daniel H. Kane, Jr.

[57] ABSTRACT

A portable and foldable maternity lounger is constructed with a three section folding frame and a frame cover of three portions. A head end portion and a foot end portion are formed in the configuration of pockets or envelopes of firm non-stretching material open on sides facing each other for sliding respectively over the ends of the frame. A mid portion substantially covers the mid section of the frame. The mid portion of the frame cover is formed by a lower panel of firm non-stretching material for supporting hips and an upper panel of elastic stretching material for expandable support of the abdomen. The upper and lower panels are joined by a continuous seam in the middle to form a continuous mid portion without uncomfortable exposure of the abdomen. The upper panel is formed with a border of firm substantially non-stretching material to distribute weight to the elastic stretching material. Elongate strips join the mid portion of the frame cover to the end portions for continuous support of a reclining person along the length of the frame and frame cover.

12 Claims, 2 Drawing Sheets

FIG. 1
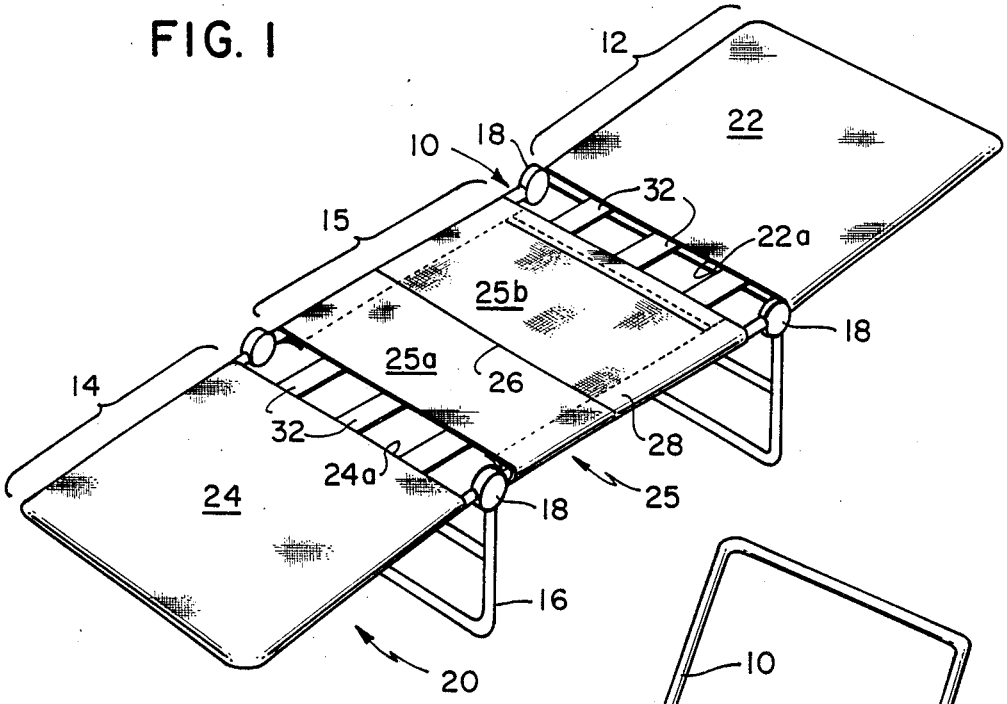
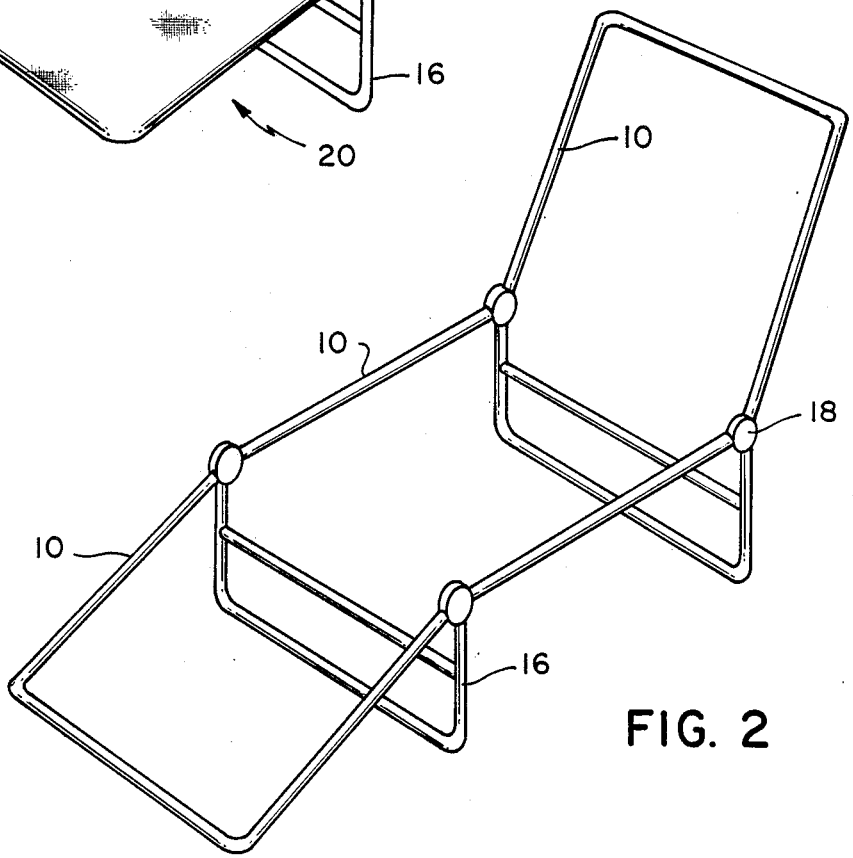
FIG. 2

MATERNITY LOUNGER

TECHNICAL FIELD

This invention relates to a new portable and foldable maternity lounger, recliner or chaise-long that permits the prospective mother to engage in sunbathing on her stomach despite the bulge of pregnancy.

BACKGROUND ART

A variety of maternity or prenatal cots and mattresses have been described which are formed with depressions, recesses, cavities or openings to accommodate the abdominal protrusion of a pregnant woman so that she can lie more comfortably on her stomach. A disadvantage of some of these cots and mattresses is that the hole or opening results in unsupported exposure of the stomach area. Furthermore the mattresses formed with cavities or depressions are not readily portable for outdoor sunbathing use. Such prior art maternity cots and mattresses are described for example in the Bien U.S. Pat. No. 3,464,069, the Pellegrini U.S. Pat. No. 2,089,854, the Skinner U.S. Pat. No. 3,378,862, the Lickert U.S. Pat. No. 4,382,306, the Pettit et al. U.S. Pat. No. 4,054,960 and the Powell U.S. Pat. No. 4,021,872.

The Castelot et al. U.S. Pat. No. 4,508,384 describes a "Pregnancy-Supporting Lounge Chair" in the form of a folding tubular lounge frame with webbing wound tightly across most of the frame including the end sections which form the headrest and footrest and a portion of the middle section. Another portion of the mid section is covered with an adjustable stretch band spaced from the webbing to expand in response to the prone stomach of a pregnant woman. A similar disadvantage of the Castelot et al. construction however is that the spaced apart stretch band still leaves portions of the protruding abdomen uncomfortably exposed and without full support between the webbing portions and stretch band or between the tubular elements of the frame.

OBJECTS OF THE INVENTION

It is therefore an object of the present invention to provide a new portable and foldable maternity lounger or recliner which comfortably supports a pregnant woman in prone position lying on her stomach.

Another object of the invention is to provide a maternity lounger or recliner having a mid section which expandably accommodates the abdominal protrusion of a pregnant woman without uncomfortable exposure of the abdomen.

A further object of the invention is to provide a maternity lounger or recliner which accommodates the bulge of pregnancy with continuity of support between the accommodating portion and firm non-stretching material portions on all sides. Thus the present invention provides continuity of expandable support extending from firm material support on one side to firm material support on the other side.

DISCLOSURE OF THE INVENTION

In order to accomplish these results the present invention provides a portable and foldable maternity lounger or recliner with a folding frame in three substantially flat foldably joined sections. A head end section and a foot end section are foldable toward and away from a mid section for either storage or use. Adjustable legs are secured to the frame.

According to the invention a frame cover is provided in three portions, a head end portion and a foot end portion comprising pockets or envelopes of firm substantially non-stretching material open on sides facing each other for sliding respectively over the head end section and foot end section of the frame. A mid portion of the frame cover joins the end portions and substantially covers the mid section of the frame.

The mid-portion of the frame cover includes a lower panel of firm non-stretching material on the foot end side of the mid section of the frame for supporting hips. An upper panel of elastic stretching material on the head end side of the mid section of the frame provides the expandable support of the abdomen. The upper panel of elastic stretching material may cover a major part of the mid-portion or slightly greater than half of the mid-portion of the frame cover. Importantly, the upper and lower panels are joined by a continuous seam in the middle to form a single continuous mid-portion of the frame cover with firm non-stretching lower support and expandable stretching upper support. The mid-portion of the frame cover is secured to the sides of the mid-section of the frame by, for example, a continuous sewn seam, folding tabs or a folding border or strip with snaps, or a combination of both. Furthermore frame cover elongate joining members or strips join the mid-portion of the frame cover to the end portions. A feature and advantage of this construction arrangement is that the invention provides continuous support of a reclining person along the length of the frame.

In the preferred example embodiment the upper panel of the mid portion of the frame cover which comprises elastic stretching material is formed with a hem or border of firm non-stretching material. Thus the invention provides a firm perimeter support around the upper panel which is joined to the mid-section of the frame at the sides, the elongate strips or joining members at the head end, and the lower panel at the foot end. The fold over tabs or fold over border portions with snaps or sewn seams secure the mid-portion of the frame cover to the mid-section of the frame at the sides and corners using the firm non-stretching material of the perimeter support or border around the upper panel. The firm non-stretching material of the lower panel also joins the upper panel to the mid-section of the frame at the foot end sides. Thus, all sides of the stretchable upper panel are joined to the tubular elements of the mid-section of the frame with firm non-stretching material.

An optional mid-section cover is also provided substantially coextensive in area with the mid-portion of the frame cover. The optional mid-section cover is made of firm non-stretching material with tabs or fold over border portions with snaps for securing the mid-section cover to the mid-section of the frame and converting the maternity lounger for ordinary use.

Other objects, features and advantages are apparent in the following specification and accompanying drawings.

BRIEF DESCRIPTION OF THE DRAWINGS

FIG. 1 is a perspective view of the portable and foldable maternity lounger or recliner according to the invention in open position.

FIG. 2 is a perspective view of the frame with the frame cover removed.

DESCRIPTION OF PREFERRED EXAMPLE EMBODIMENT AND BEST MODE OF THE INVENTION

Figure 3:
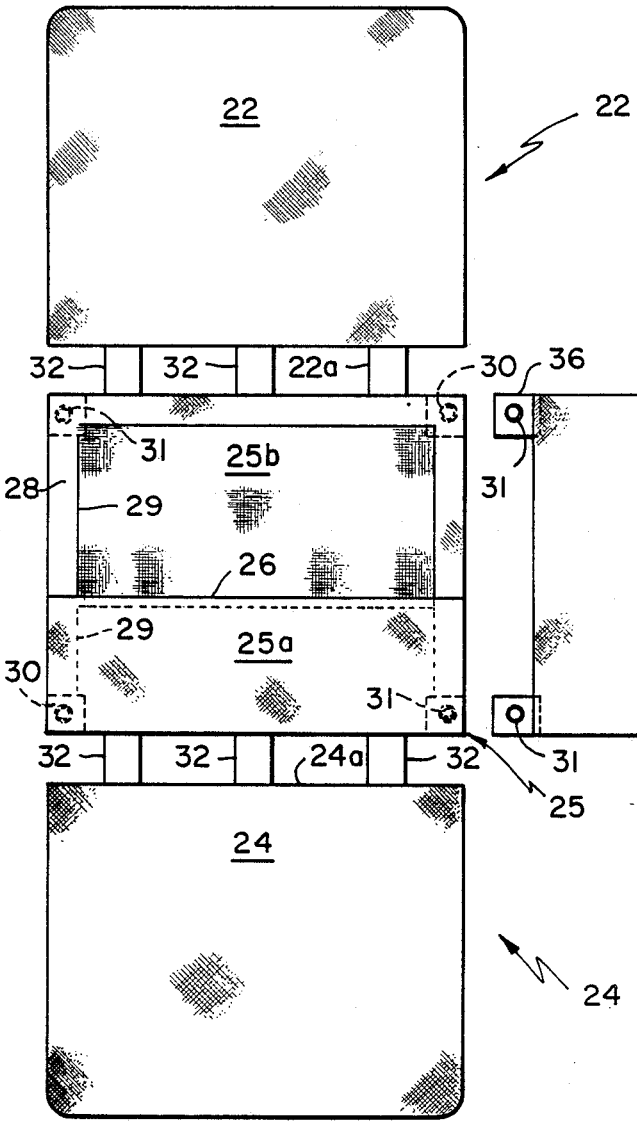
FIG. 3 is a plan view of the back side of the frame cover removed from the frame.

A portable and foldable maternity lounger or recliner according to the invention is illustrated in FIG. 1 with the frame and back of the frame cover shown separately in FIGS. 2 and 3 respectively. The folding frame 10 is made up of three substantially flat sections foldably joined, a head section or head end section 12, a foot section or foot end section 14, and an intermediate mid-section 15, all three of substantially the same length. The end sections 12 and 14 of the frame 10 are foldable toward each other and the mid-section for storage and away from each other and the mid-section for use. Positioning gears 18 may be set for setting and fixing the desired angles of the head section 12 and foot section 14 for use in the open position. The legs 16 secured to the frame may also be adjustable and foldable.

The frame cover 20 is also composed of three portions. The head end portion 22 and foot end portion 24 are formed in the configuration of pockets or envelopes of firm non-stretching material such as canvas with openings 22*a* and 24*a* respectively on sides facing each other for sliding respectively over the head end section 12 and foot end section 14 of the frame 10. The mid-portion 25 of the frame cover 20 substantially covers the mid-section 15 of the frame 10.

The mid-portion 25 of the frame cover 20 is composed of two panels including a lower panel 25*a* of firm non-stretching material such as canvas on the foot end side of the mid-section 15 of the frame 10 for supporting hips. The mid-portion 25 is also composed of an upper panel 25*b* of elastic stretching material such as, for example, Spandex (TM) elastic material on the head end side of the mid-section 15 of the frame 10 for expandable support of the abdomen. As used here in the specification and in the claims the phrases "firm non-stretching material" and "substantially non-stretching material" are intended to refer to the well known material characteristics of canvas and similar materials. On the other hand the phrases "elastic stretching material" and "elastic relatively stretching material" are intended to refer to the well known material characteristics of Spandex (TM) elastic material and to its relatively elastic stretchable properties compared with canvas and similar substantially non-stretching materials. The upper panel 25*b* may cover an area approximately one half or slightly greater than half the area of the mid-portion 25 or a major part of mid-portion 25. The lower and upper panels 25*a* and 25*b* are joined by a continuous seam 26 in the middle such as, for example, a sewn seam to form a single continuous mid-portion 25 of the frame cover 20. The mid-portion 25 of the frame cover therefore affords firm non-stretching lower support and expandable stretching upper support without exposure so that a pregnant woman can lie prone on her stomach with less discomfort.

The mid-portion 25 of the frame cover 20 is secured to the mid-section 15 of the frame 10 by a combination of continuous sewn seams 29 hereafter described and fold over tabs 30 positioned at the corners of the mid-portion 25. The tabs 30 are fitted for example with snaps 31 complementary with snaps on the under surface of the panels 25*a* and 25*b*.

In the preferred example of FIGS. 1 and 3 the upper panel 25*b* of the mid portion 25 of the frame cover is formed with a hem or border 28 of firm non-stretching material such as canvas. The canvas border 28 provides perimeter support around the expandable elastic material of the upper panel 25*b* particularly at the sides and head end of the mid-section of the frame. The fold over tabs 30 for securing the corners of the mid-portion 25 to the mid-section 15 of the frame 10 are joined by snaps 31 to the firm material border or hem 28.

The frame cover is completed by the elongate longitudinal strips 32 joining the lower and upper panels 25*a* and 25*b* respectively of the mid-portion 25 of the frame cover 20 respectively to the foot end portion 24 and head end portion 22. The longitudinal strips 32 are made of firm non-stretching material such as canvas and afford continuous support of a reclining person along the length of the frame from one end of the frame cover to the other. In particular, the strips 32 joining the head end portion 22 of the frame cover 20 with the mid-portion 25 are secured to the canvas hem or border 28 at the top of the upper panel 25*b* for distributing weight on the frame cover across the entire upper panel 25*b* of expandable elastic material. The construction arrangement of the firm material hem or border 28 avoids localized stresses which would otherwise distort the panel 25*b* of elastic material. The strips 32 joining the foot end portion of the frame cover 20 with the mid-portion 25 are secured to the lower panel 25*a* of firm non-stretching material which similarly distributes weights and stresses across the upper panel 25*b*.

As shown is FIGS. 1 and 3 the mid-portion 25 of the frame cover 20 is joined to the tubular elements of frame 10 along the sides by substantially continuous sewn seams 29 of the border 28 of canvas or other firm substantially stretching material and the lower panel 25*a*. To accomplish this, the border 28 and lower panel 25*a* are formed with overlapping portions which wrap around the tubular elements at the sides of the mid-section 15 of frame 10 and are sewn in place along the seam 29. Alternatively, in order to provide a removable mid-portion the overlapping border portions at the sides may be fitted, for example, with snaps so that the mid-portion 25*b* is removable and replaceable.

In either example, corner tabs 30 are provided for reinforcement and securing at the corners of the mid-section of the frame 10 by means of complementary snaps 31 formed on the tabs 30 and on the undersurface of the mid-portion 25 within the boundary of the border or hem 28 of the upper panel 25*b* and at the foot end corners of lower panel 25*a*. The snap couplings are therefore always secured or anchored in firm substantially non-stretching material such as canvas.

Figure 4:
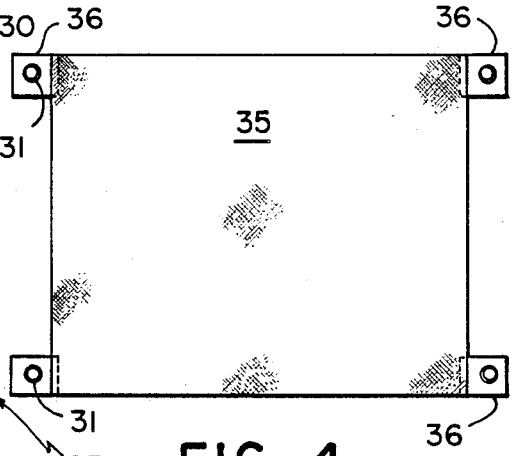
FIG. 4 is a plan view of the optional mid-section cover for converting the maternity lounger for regular use.

For converting the maternity lounger for general use as a recliner, an optional mid-section cover 35 is provided as illustrated in FIG. 4. The mid-section cover 35 is provided with fold over tabs 36 fitted for example with complementary snaps 37 for securing the optional mid section cover 35 to the mid-section of the frame over the middle portion 25 of the frame cover 20. The optional cover 35 is made of a firm non-stretching material such as canvas to provide continuous firm support throughout the length of the frame cover 20 for general use of the recliner.

In order to secure the mid-section cover 35 over the mid-portion 25 of cover 20 on the mid-section 15 of frame 10, the snaps 31 on tabs 30 of the mid-portion 25 are formed as double sided snaps or double snaps. On one side the double sided snaps 31 are coupled to complementary snaps formed on the undersurface of cover mid-portion 25 at the corners, anchored in firm non-stretching border material as heretofore described. The mid-portion 25 is thereby well secured at the corners. When the mid-section cover 35 is used, it is placed over mid-portion 25. The tabs 36 are wrapped around the tubular elements at the sides of frame 10 and the underlying tabs 30 of mid-portion 25. The snaps 37 on tabs 36 of the mid-section cover 35 are then snapped or coupled into the other side or outer side of the double sided snaps 31, securing the mid-section cover 35 in place at the corners.

While the invention has been described with reference to particular example embodiments it is intended to cover all modifications and equivalents within the scope of the following claims.

I claim:

1. A portable and foldable maternity lounger comprising:

a folding frame comprising three substantially flat foldably joined sections, a head end section, a foot end section, and a mid-section, said end sections being foldable toward and away from the mid-section for either storage or use and adjustable leg means secured to the frame;

and a frame cover comprising three portions, a head end portion and a foot end portion comprising pockets or envelopes of firm substantially non-stretching material open on sides facing each other for sliding respectively over the head end section and foot end section of the frame, and a mid-portion substantially covering the mid-section of the frame;

said mid-portion of the frame cover comprising a lower panel of firm substantially non-stretching material on the foot end side of the mid-section of the frame for supporting hips, and an upper panel of elastic relatively stretching material on the head end side of the mid-section of the frame for expandable support of the abdomen, said upper and lower panels being joined by a continuous seam in the middle of the mid-portion of the frame cover to form a single continuous mid-portion of the frame cover with firm substantially non-stretching lower support and relatively expandable stretching upper support, and mid-section securing means for securing the mid-portion of the frame cover to the mid-section of the frame;

said frame cover further comprising flexible joining means comprising firm substantially non-stretching material joining the mid-portion of the frame cover to the end portions for continuous support of a reclining person along the length of the frame cover and frame;

said upper panel of the mid portion of the frame cover which comprises elastic stretching material being formed with a hem or border of firm substantially non-stretching material providing perimeter support around the upper panel for securing to the mid-section of the frame and for more evenly distributing stresses to said upper panel.

2. The maternity lounger of claim 1 wherein the mid-section securing means comprises fold over tab means joined to the lower panel and the border of the upper panel for securing the mid portion of the frame cover to the mid section of the frame.

3. The maternity lounger of claim 2 further comprising an optional mid-section cover substantially coextensive in area with the mid portion of the frame cover, said mid-section cover comprising firm substantially non-stretching material and second mid-section securing means for securing the mid-section cover to the mid-section of the frame for converting the maternity lounger to regular use.

4. The maternity lounger of claim 3 wherein the second mid-section securing means comprise fold over tabs joined to the sides of the mid-section cover for securing to the fold over tab means of the upper and lower panels of the mid-portion of the frame cover.

5. The maternity lounger of claim 4 wherein the fold over tab means of the upper and lower panels of said mid-portion of the frame cover comprise double-sided snaps.

6. The maternity lounger of claim 1 wherein the frame cover joining means comprises longitudinal strips of said substantially non-stretching material joining the upper and lower panels of the mid-portion of the frame cover respectively to the head end and foot end portions.

7. The maternity lounger of claim 1 wherein the frame cover joining means comprises strips of said substantially non-stretching material joining the upper and lower panels of the mid-portion of the frame cover respectively to the head end and foot end portions, said strips of material joining the upper panel with the head end portion being joined to the upper panel at the hem or border of firm substantially non-stretching material.

8. The maternity lounger of claim 7 wherein the upper and lower panels comprises sewn seams joining the mid-portion of the frame cover to the sides of the mid-section of the frame.

9. The maternity lounger of claim 1 wherein the lower panel of firm substantially non-stretching material of the mid-portion of the frame cover and the hem or border of firm substantially non-stretching material around the perimeter of the upper panel of the mid-portion of the frame cover comprise canvas material.

10. A portable and foldable maternity lounger or recliner comprising:

a folding frame comprising three substantially flat foldably joined sections, a head end section, a foot end section, and a mid-section, said end sections being foldable toward and away from the mid-section for either storage or use and adjustable leg means secured to the frame;

and a frame cover comprising three portions, a head end portion and a foot end portion comprising firm substantially non-stretching material secured respectively to the head end section and foot end section of the frame, and a mid-portion substantially covering the mid-section of the frame;

said mid-portion of the frame cover comprising a lower panel of firm substantially non-stretching material on the foot end side of the mid-section of the frame for supporting hips, and an upper panel of elastic relatively stretching material on the head end side of the mid-section of the frame for expandable support of the abdomen, said upper and lower panels being joined by a continuous seam in the middle of the mid-portion of the frame cover to form a single continuous mid-portion of the frame cover with firm substantially non-stretching lower support and expandable relatively stretching upper support, and mid-section securing means for securing the mid-portion of the frame cover to the mid-section of the frame;

said upper panel of the mid-portion of the frame cover being formed with a hem or border of firm substantially non-stretching material providing perimeter support around the upper panel, said mid-section securing means for securing the mid-portion of the frame cover to the mid-section of the frame being joined to the mid-portion at said hem or border for more evenly distributing weight to said upper panel;

said frame cover further comprising a plurality of flexible joining means of firm substantially non-stretching material joining the upper and lower panels of the mid portion of the frame cover respectively to the head end and foot end portions, said joining means joining the upper panel and head end portion of the frame cover being joined to the upper panel at said hem or border of firm substantially non-stretching material for distributing weight across the upper panel;

whereby said frame cover affords continuous support of a reclining person along the length of the frame from the foot end of the frame cover to the head end.

11. The maternity lounger or recliner of claim 10 wherein the head end portion and foot end portion of the frame cover comprise pockets or envelopes open on sides facing each other for sliding respectively over the head end section and foot end section of the frame.

12. The maternity lounger or recliner of claim 10 wherein the joining means comprise flexible strips of said substantially non-stretching material.

* * * * *